US009297251B2

(12) United States Patent
Poitzsch

(10) Patent No.: US 9,297,251 B2
(45) Date of Patent: Mar. 29, 2016

(54) DRILL BIT SYSTEMS WITH TEMPERATURE SENSORS AND APPLICATIONS USING TEMPERATURE SENSOR MEASUREMENTS

(71) Applicant: SCHLUMBERGER TECHNOLOGY CORPORATION, Sugar Land, TX (US)

(72) Inventor: Martin E. Poitzsch, Derry, NH (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 299 days.

(21) Appl. No.: 13/771,329

(22) Filed: Feb. 20, 2013

(65) Prior Publication Data

US 2014/0231142 A1 Aug. 21, 2014

(51) Int. Cl.
*E21B 12/00* (2006.01)
*E21B 47/06* (2012.01)
*E21B 10/00* (2006.01)

(52) U.S. Cl.
CPC ..... *E21B 47/065* (2013.01); *E21B 10/00* (2013.01)

(58) Field of Classification Search
CPC ..... E21B 12/00; E21B 44/00; E21B 45/00
USPC ..... 175/40, 50, 24
See application file for complete search history.

(56) References Cited

U.S. PATENT DOCUMENTS 3,062,302 A * 11/1962 Toth ..... E21B 12/02 175/39
5,475,309 A * 12/1995 Hong et al. ..... 324/338
6,429,653 B1 * 8/2002 Kruspe et al. ..... 324/303
6,543,312 B2 4/2003 Sullivan et al.
6,571,886 B1 * 6/2003 Sullivan et al. ..... 175/40
7,168,506 B2 * 1/2007 Boucher ..... E21B 47/12 175/48
8,087,477 B2 1/2012 Sullivan et al.
8,215,384 B2 * 7/2012 Trinh et al. ..... 166/177.1
8,757,291 B2 * 6/2014 Kumar ..... E21B 10/08 175/39
8,960,329 B2 * 2/2015 Downton ..... E21B 10/26 175/385
2003/0209365 A1 * 11/2003 Downton ..... 175/50
2003/0221869 A1 * 12/2003 Ireland ..... 175/40
2006/0065395 A1 * 3/2006 Snell ..... 166/255.2
2006/0175057 A1 * 8/2006 Mandal et al. ..... 166/254.2
2007/0186639 A1 * 8/2007 Spross ..... E21B 7/067 73/152.03
2007/0272442 A1 11/2007 Pastusek et al.
2009/0251331 A1 * 10/2009 Wassermann et al. ..... 340/854.3
2011/0005841 A1 * 1/2011 Wood et al. ..... 175/385
2011/0060527 A1 * 3/2011 Teodorescu ..... 702/9
2011/0186353 A1 * 8/2011 Turner et al. ..... 175/40
2011/0226531 A1 * 9/2011 Jones ..... 175/50
2012/0031669 A1 * 2/2012 Foster ..... 175/45

(Continued)

*Primary Examiner* — Kenneth L Thompson
(74) *Attorney, Agent, or Firm* — Daniel S. Matthews

(57) ABSTRACT

A drill bit includes a plurality of blades. The blades provide a plurality of cutting elements or teeth arranged on a leading face of the blade. At least one temperature sensor is provided adjacent at least one of the teeth of at least one blade to sense a local temperature of the blade adjacent that tooth. Multiple temperature sensors may be provided adjacent different teeth of a blade or adjacent the teeth of at least two blades, or adjacent multiple teeth of multiple blades. Another temperature sensing element may be provided on a proximal portion of the blade distant from the cutting elements or on the shank of the bit to provide a reference temperature for the drill bit or for the blade. Information obtained by the temperature sensing elements is used to provide information regarding at least one of the drill bit, the drilling environment and the formation.

40 Claims, 7 Drawing Sheets

(56) References Cited

U.S. PATENT DOCUMENTS

2012/0152617 A1* 6/2012 Hunt et al. ..... 175/39
2013/0020130 A1* 1/2013 Trinh et al. ..... 175/45
2013/0068525 A1* 3/2013 DiGiovanni ..... E21B 47/01 175/40

* cited by examiner

DRILL BIT SYSTEMS WITH TEMPERATURE SENSORS AND APPLICATIONS USING TEMPERATURE SENSOR MEASUREMENTS

BACKGROUND

1. Field

This case relates to drill bit systems for drilling geological formations, and more particularly to drill bit systems incorporating temperature sensors. This case also relates to the use of temperature sensor measurements obtained from drill bits having temperature sensors, including, but not limited to the use of the measurements to improve drill bit reliability, to predict wear, and to increase drilling efficiency.

2. Background

Geological formations are drilled for exploration and exploitation purposes. In commercial environments, the drilling may include a drilling rig and a drill string with a drill bit located at the distal end of the drill string. Different types of drill bits are known, including roller cone bits and polycrystalline diamond compact (PDC) bits. Roller cone bits include a plurality of cutting elements arranged on two or three cones that rotate on bearings about their own axis as the drill string turns the body of the bit. PDC bits include a plurality of fixed (also called "stationary") lands or blades separated by flutes with the blades including a plurality of synthetic diamond discs (teeth) that provide a scraping cutting surface as the drill string turns the body of the bit. While PDC bits rotate about the longitudinal axis of the drill string, they are often called "stationary" bits because they do not also rotate separately as do roller cone bits.

PDC bits drill primarily due to a wedging mechanism that involves scraping and grinding. More particularly, a vertical force is applied to the teeth as a result of applying drill collar weight to the bit, and a horizontal force is applied to the teeth as a result of applying torque that turns the bit. The result of these forces defines the plane of thrust of the teeth. As the forces are applied, the teeth shear off cuttings from the formation. As the PDC bit encounters the formation, the PDC bit heats up due to friction. In order to reduce the heat build-up, it is common to inject a drilling "mud" through the drill string and down to the bit to cool the bit. Thus, in drilling into the formation, the drill operator may control the drill string RPM, the mud flow-rate, and the weight-on-bit (WOB), each of which will impact the build-up of heat at the drill bit.

Drill bit failure requires a tripping of the drill string out of the borehole, and tripping is costly because of the time and effort involved. Drill bit failure can occur for various reasons including gradual bit wear, bit damage (e.g., loss of one or more cutter elements), and bit balling (i.e., accumulation of clay or other materials coating the bit face and preventing the cutter elements from gaining purchase into the formation).

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to one aspect, a drill bit system is provided and includes a shaft (also called a "shank") and a head having a plurality of blades (also called "wings," "lands" or "ribs") at the distal end of the shaft. The blades are separated by a plurality of flutes. Each blade has a distal end that is provided with a plurality of cutting elements or teeth that are arranged on a leading face of the blade. A temperature sensing element is provided adjacent to at least one of the teeth of at least one blade. According to one aspect, the temperature sensing element senses a local temperature of the blade adjacent the tooth. In one embodiment, multiple temperature sensing elements are provided adjacent different teeth of at least one blade. In another embodiment, a temperature sensing element is provided adjacent at least one of the teeth of at least two blades. In another embodiment, multiple temperature sensing elements are provided adjacent different teeth of at least two blades.

In one embodiment, in addition to providing a temperature sensing element adjacent a cutting tooth of a blade of the drill bit, another temperature sensing element is provided either on a proximal portion of the blade distant from the cutting elements or on the shank of the bit. This additional temperature sensing element may serve to provide a reference temperature for the drill bit or for the blade.

In one aspect, the one or more temperature sensing elements on the drilling bit are coupled to circuitry or a processor that can analyze the information provided by the temperature sensing element(s). In one embodiment, a coupling of the temperature sensing elements and the circuitry or processor is accomplished by one or more electrical conductors (e.g., wire(s)). In another embodiment, coupling is accomplished by fiber optics. In another embodiment, coupling is accomplished by wireless transmission (e.g., short-hop electromagnetic or acoustic transmission).

In one aspect, the temperature information obtained by the temperature sensing element is used to provide information regarding at least one of the drill bit, the drilling environment and the formation.

DETAILED DESCRIPTION

Figure 1:
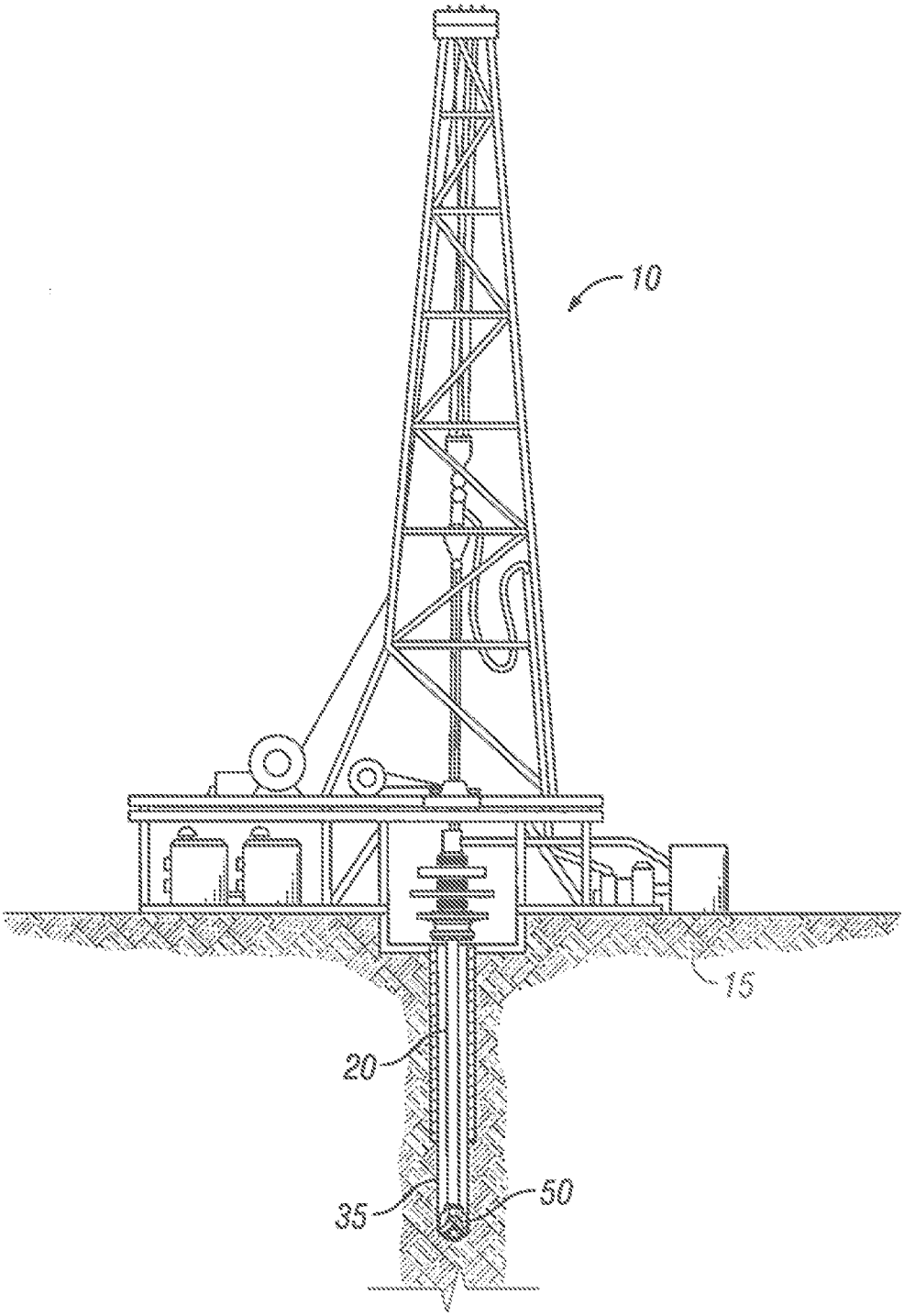
FIG. 1 is a schematic diagram of a drilling operation including a drill bit located in a formation borehole.

A drilling operation is shown in FIG. 1 and includes a drilling rig 10 located on the surface of an earth formation 15. The drilling rig 10 supports a drill string 20 having a drill bit 50 located at its distal end. The drill bit 50 and a portion of the drill string 20 are shown in a borehole 35 drilled by the bit 50 in the formation 15.

Figure 2:
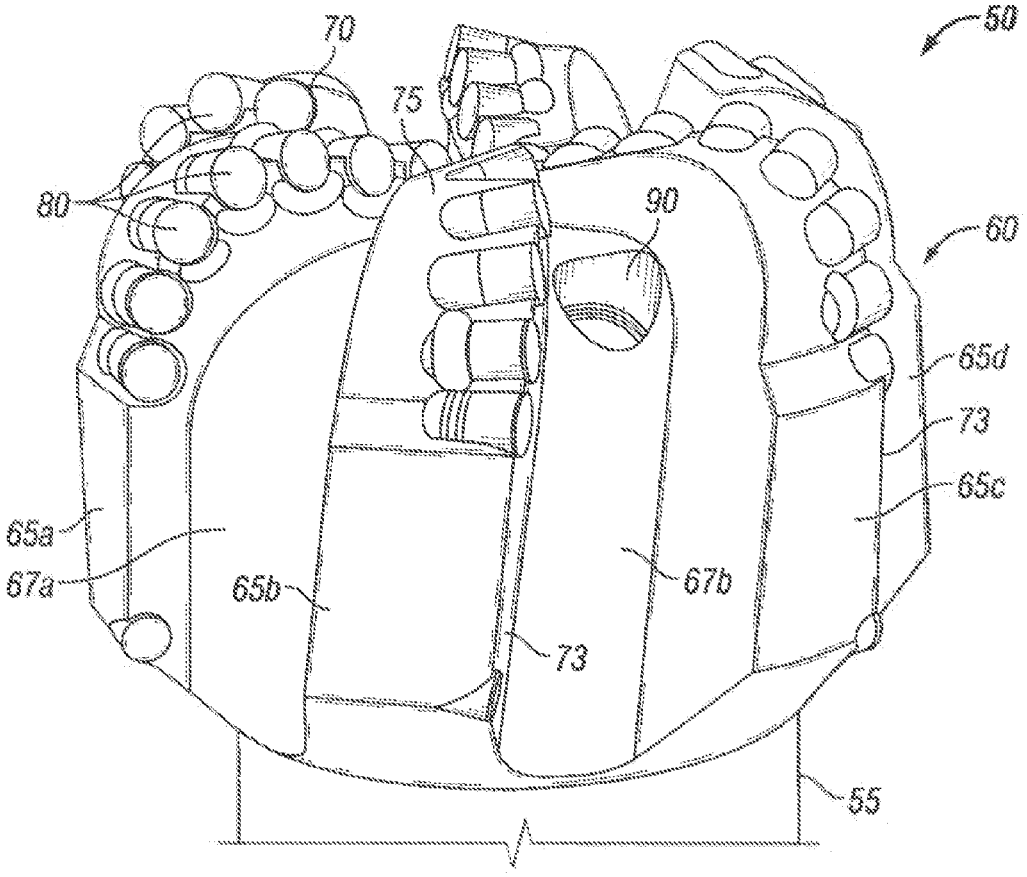
FIG. 2 is a prior art schematic of a polycrystalline diamond compact (PDC) drill bit.

A prior art stationary drill bit 50 is seen in FIG. 2. Drill bit 50 is a polycrystalline diamond compact (PDC) type drill bit having a shank 55 and a head 60. Head 60 includes a plurality of blades 65*a*, 65*b*, 65*c*, 65*d* . . . (also called "wings," "lands" or "ribs") that define therebetween a plurality of flutes 67*a*, 67*b* . . . . The blades are generally arcuate and have a plurality of openings or cavities 70 drilled or formed into their leading faces 73 at the distal ends 75 of the blades. The openings 70 are generally situated perpendicular to the longitudinal axis of the drill bit and in the direction of rotation of the bit. The openings 70 receive cutting elements or teeth 80 that project from the leading faces 73 and are adapted to scrape and cut. The cutting elements may be formed with a tungsten carbide body and a diamond face or edge (e.g., polycrystalline diamond compact (PDC)). The drill bit may be formed from cast steel with a central passageway (not shown) for receiving drilling mud. At the distal end of the passageway, an opening 90 is formed in one or more flutes for receiving a nozzle (not shown) for delivering drilling mud to the drill bit tip 75.

Figure 4:
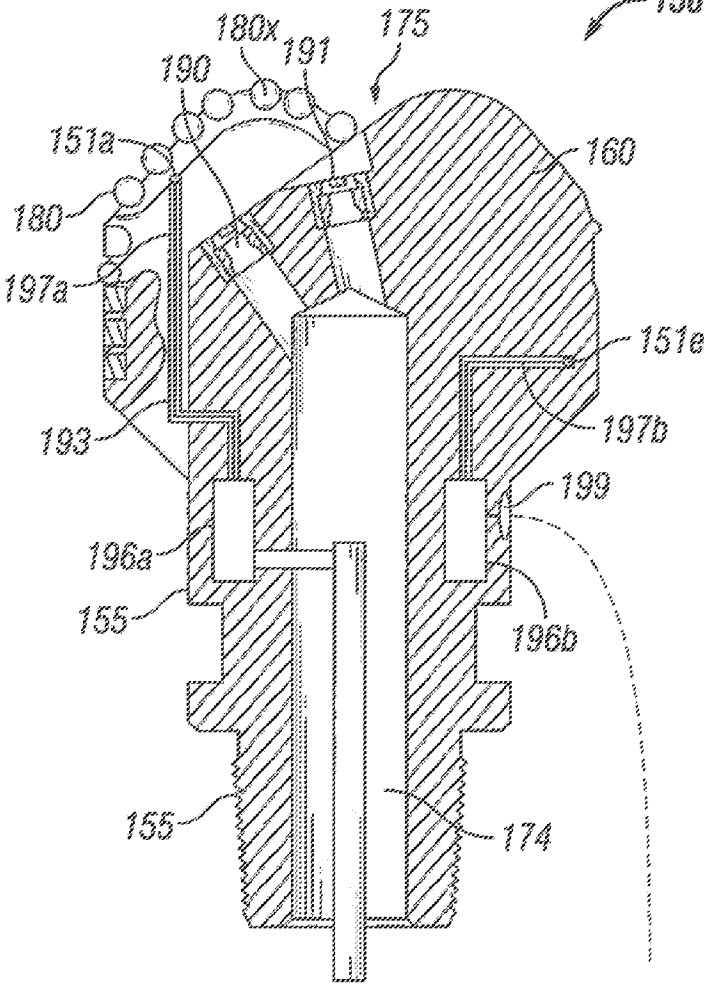
FIG. 4 is a schematic partially cross-sectional view of the drill bit of FIG. 3.
Figure 3:
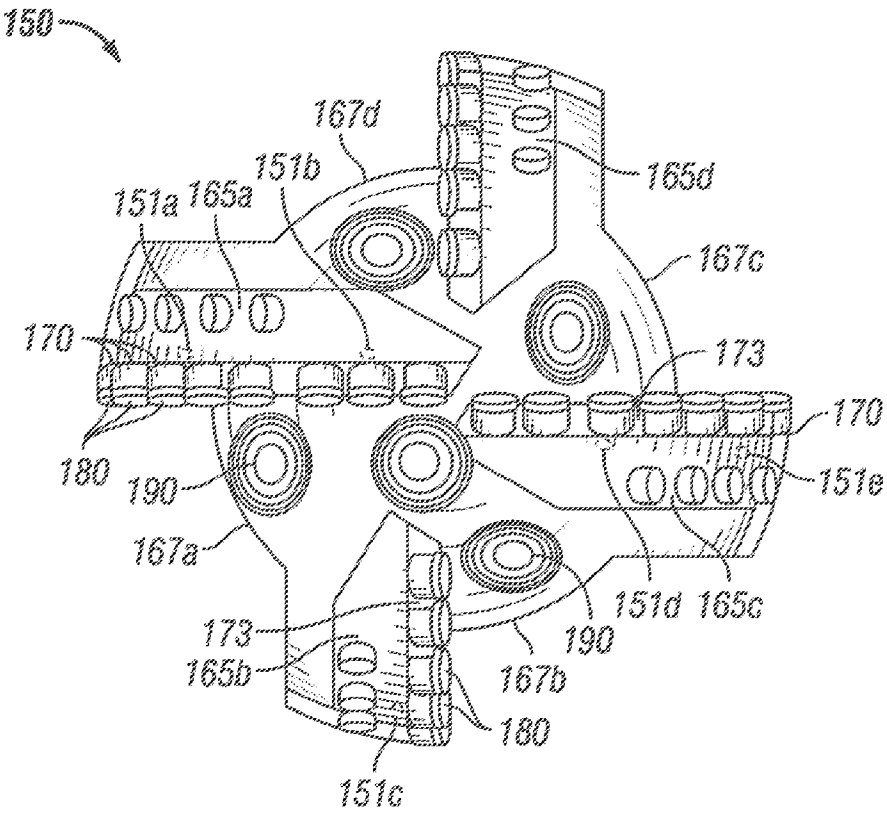
FIG. 3 is a bottom view of a PDC drill bit having a plurality of temperature sensor elements.

FIGS. 3 and 4 show a stationary drill bit 150 similar to prior art drill bit 50 (with like elements given like numbers but increased by "100"), but additionally containing a plurality of temperature sensor elements 151*a*. Drill bit 150 may be used in conjunction with the drilling rig 10 of FIG. 1. Drill bit 150 includes a shank 155 and a head 160. Head 160 includes a plurality of blades 165*a*, 165*b*, 165*c*, 165*d* that define therebetween a plurality of flutes 167*a*, 167*b*, 167*c*, 167*d*. The blades 165*a*-165*d* are generally arcuate (as seen best in FIG. 4) and have a plurality of openings or cavities 170 drilled into their leading faces 173 at the distal ends 175 of the blades. The blades 165*a*-165*d* may have different or the same numbers of openings 170 provided. The openings 170 are generally situated perpendicular to the longitudinal axis of the drill bit and in the direction of rotation of the bit. The openings 170 receive cutting elements or teeth 180 that project from the leading faces 173 and are adapted to scrape and cut. Because the blades are arcuate, the teeth 180 assume different axially positions relative to the longitudinal axis of the drill bit 150. Thus, at least one tooth on the blade (denoted 180*x*) may be located at an apex (distal-most location) of the drill bit. In addition, the teeth 180 may assume different radially positions relative to the longitudinal axis. As shown in FIG. 4, the distal-most tooth 180*x* is not the radially-inwardly-most tooth. The drill bit 150 has a central passageway 174 for receiving drilling fluid (mud). At the distal end of the passageway, openings 190 are formed in the flutes, and a central opening is also provided for receiving nozzles 191 that deliver drilling mud to the drill bit tip 175.

In FIG. 3, drill bit 150 is shown with five temperature sensor elements 151*a*, 151*b*, 151*c*, 151*d* and 151*e* (each also referred to generally as a temperature sensor 151). Temperature sensor elements 151*a* and 151*b* are shown on the distal end of blade 165*a*, temperature sensor element 151*c* is shown on the distal end of blade 165*b*, temperature element 151*d* is shown on the distal end of blade 165*c*, and temperature sensor element 151*e* is shown on the proximal end of blade 165*c* (see FIG. 4). Each of sensor elements 151*a*-151*d* is situated adjacent respective teeth 180 of the tool bit. For purposes of this specification and the claims, the term "adjacent" means "a closest protected location, generally within 3 millimeters of" the tooth or other element, when used to describe a temperature sensor location relative to a cutting tooth or other element. It should be appreciated that in one aspect it may be desirable to protect the sensor from direct contact with the harsh environment of the borehole itself while still providing an extremely accurate measurement. Therefore, it may be desirable to provide a thin layer of high integrity protective heat conductive material (e.g., metal) between the tooth or other element and the sensor.

As seen best in FIG. 3, each of sensor elements 151-151*d* are located at different radial positions relative to the longitudinal axis of the drill bit 150. Thus, for example, temperature sensor element 151*c* is shown as being most radially distant of the sensors located adjacent the drill bit teeth, whereas temperature sensor element 151*b* is shown as being most radially inward of those four sensors.

In one embodiment, only one temperature sensor element 151 is provided adjacent a tooth of one of the blades.

In other embodiments, at least one temperature sensor element 151 is provided adjacent one tooth of at least two blades or of at least three blades, or at least four blades, or on every blade.

In another embodiment, at least two temperature sensor elements 151 are provided adjacent two different teeth of one of the blades.

In one embodiment, at least two temperature sensors elements 151 are provided at different radial positions on two different blades.

In one embodiment, temperature sensor element 151*e* is located on a proximal portion of a blade distant the closely spaced teeth 180.

In one embodiment, a temperature sensor element 151 is located in a blade of the drill bit 150 by drilling a pathway 193 inside the shank 155 and the blade (as seen in FIG. 4) and pushing the temperature sensor element (here element 151*a*) through the pathway until it is situated below the top surface of the blade and adjacent at least one tooth 180. The temperature sensor element 151 may be secured in place with a heat conductive epoxy or by other suitable means. The temperature sensor element 151 may then be coupled to circuitry or a processor that can analyze the information provided by the temperature sensing element(s) 151 as hereinafter described. The pathway 193 may be used as a wiring channel (discussed hereinafter) and plugged with a plug (not shown) to protect the temperature sensor element 151 from drilling mud or other substances.

In another embodiment, a temperature sensor 151 is located in a blade of the drill bit 150 by drilling or forming a cavity in the blade adjacent a tooth from the outside of the blade. The temperature sensor element 151 may be secured in place with a heat conductive epoxy or by other suitable means and the cavity may be plugged with a plug (not shown) to protect the temperature sensor element 151 from the formation or from the drilling mud or other substances.

In another embodiment, a temperature sensor 151 is located in the opening 170 provided for a tooth prior to the tooth being inserted such that the temperature sensor 151 is in direct contact with the tooth. The temperature sensor element 151 may be secured in place in the opening with a heat conductive epoxy or by the fit or securement of the tooth itself, or by other suitable means.

In one embodiment, a coupling of the temperature sensing elements 151 and the circuitry or processor is accomplished by one or more electrical conductors (e.g., wire(s)). In another embodiment, coupling is accomplished by fiber optics. In another embodiment, coupling is accomplished by wireless transmission (e.g., short-hop electromagnetic or acoustic transmission).

FIG. 4 shows two mechanisms for coupling a temperature sensing element 151 to circuitry or a processor. More particularly, FIG. 4 shows sensor 151*a* coupled to front-end electronic circuitry 196*a* (seated in a cavity in the shank 155) via multi-conductor electric wiring/cabling 197*a* located in pathway 193. In turn, front-end electronic circuitry 196*a* is shown coupled to a coaxial inter-sub connector (electrical or fiber-optical) 198 that extends from the front-end circuitry 196*a* via a radial bore in the shank and through the central passageway 174 of the shank 155 to the formation surface and to a processor (not shown). Front-end electronic circuitry 196*a* may take many forms and may accomplish many functions. By way of example only, front-end electronic circuitry may convert signals from the temperature sensing element 151 into digital information containing temperature values. The front-end circuitry may also average or otherwise filter the temperature values. Alternatively, or in addition, the front-end circuitry might analyze changes in the temperature values and send an alert or warning flag upon detecting a change in excess of a pre-set threshold or rate. In some embodiments, the temperature readings, alerts and warning flags may be realized in analog form and passed on up the string as analog signal levels. The front-end circuitry may also provide power to the temperature sensor(s). The power provided may be either continuous in time or intermittent according to a power-saving mechanism.

Also shown in FIG. 4 is temperature sensing element 151*e* that is located in shank 155 and is coupled to front end circuitry 196*b* located in a cavity in the shank 155 via wiring 197*b*. In turn, front end circuitry 196*b* is coupled to a transducer or antenna 199 located on the periphery of the shank 155 that is adapted to relay temperature data wirelessly (e.g., electromagnetically, acoustically, or otherwise). In one embodiment, the transducer or antenna 199 relays that information over a "short-hop" distance of a few meters back up to a receiver sub or module (not shown) located above the drill bit, which may have a rotating mud motor or steering device located in between.

It will be appreciated that while FIG. 4 shows two mechanisms for coupling a temperature sensor element 151 to circuitry or a processor, one or the other mechanisms can be chosen for all temperature sensors on the drill bit, and a single front-end electronic circuitry module may be used to process information from all temperature sensor elements 151. Also, while multi-conductor electric cabling has been described, fiber-optic cabling possibly including Distributed Temperature Sensing (DTS) can be utilized. Alternatively, single-conductor cabling can be utilized using the bit body as a "common" or return. Other suitable mechanisms may likewise be utilized.

The temperature sensors 151 may be of any type consistent with downhole temperature values and environmental conditions; e.g., thermocouples, platinum sensors, resistance temperature detectors (RTDs), semiconductor sensors, or others. In addition, sensors based on optical interrogation may be utilized such as DTS whereby the Raman-scattered light from the bulk of an optical fiber gives a time-domain-reflectometric reading of the fiber's distributed temperature(s). Such a fiber arrangement could give a distributed temperature profile across or along a drill bit. For example, a helical fiber winding its way from the bit face to the shank could give a profile of temperature readings along the length and circumference of the drill bit.

It should be appreciated that a temperature sensing element adjacent a tooth of a drill bit will provide a local temperature measurement at that point. A temperature sensing element located on a blade far from the teeth may provide an "average" temperature for the blade, and a temperature sensing element located on a shank may provide an average temperature for the tool bit or a reference temperature for the environment.

A particular temperature at a specific point (local temperature) such as at a particular tooth may be denoted by $T_i$, with the subscript i labeling the measurement point. An average temperature <T> of a plurality of specific points can be computed from any array of N different temperature measurements at various points in the drill bit according to $$\langle T\rangle=\Sigma T_i/N \tag{1}$$

Various temperature points can be compared to this average bit temperature by subtraction $\{T_i-\langle T\rangle\}$. Likewise, various temperature points can be compared to a reference temperature by subtraction $\{T_i-T_{ref}\}$, where $T_{ref}$ is some reference temperature measurement point, such as on the bit shank, well back from the contact points and cutter elements.

Differential schemes such as a Wheatstone bridge arrangement (with different temperature sensors as bridge elements, e.g.) may be used to make more accurate or precise measurements of small differences in temperature from point to point directly.

With the use of one or more of temperature sensing elements 151*a*-151*d* adjacent the teeth 180 of the drill bit, with or without temperature sensing element 151*e* located on the shank, information can be obtained regarding at least one of the drill bit, the drilling environment, and the formation. More particularly, changes in various local drill bit temperatures may be used to infer changes in the condition or environment of the drill bit.

As previously suggested, three operational factors that the driller actually controls—drill-string rotational velocity (rpm), mud flow-rate, and weight-on-bit (WOB)—are very significant determinants of drill bit temperature, as they control the amount of friction at the cutting surfaces of the drill bit and also the amount of convective cooling that is applied to the bit by the flowing mud. In addition, the driller is able to measure the average rate of penetration (ROP) of the drilling assembly and also the torque at the surface (and possibly close to the bit, as well). All the temperature interpretations that are performed (below) desirably take these factors into account. For example, if rpm, flow-rate, and WOB are held constant, and ROP drops along with an increase in average drill bit temperature, then that may be consistent with either an increase in formation hardness or mechanical damage to the bit, such as cutter dulling or damage or loss of a cutter. Moreover, the formation temperature does increase gradually with depth and is typically characterized by a "geothermal gradient" of about +2° C. per 100 m of increased depth.

According to one aspect, average bit temperature <T> rise over time d<T>/dt, to the extent that this temperature increase is not attributable to WOB or rpm or mud flow-rate changes or geothermal gradient, could indicate bit wear, bit damage (e.g., lost tooth), or bit balling (accumulation of clay or other materials coating the bit face and preventing the cutters from gaining purchase into the formation). Gradual wear or dulling or bit balling would be expected to lead to a gradual temperature increase (small d<T>/dt). A relative abrupt change in the rate of temperature rise (large d<T>/dt) could indicate the loss of one or more teeth from one or more blades of the bit. The average bit temperature may be the average temperature calculated from a plurality of temperatures indications provided by a plurality of sensors located adjacent the teeth as in equation (1), or the temperature sensed by a sensing element located on a blade or on the shaft far from the teeth. Thus, in one embodiment, the rate of temperature rise is measured and compared to either previous rate of temperature rise or to a threshold value, and if the rate of temperature rise is increasing or a threshold is exceeded, action is taken accordingly. The action could include, inter alia one or more of reducing WOB or rpm, increasing the mud flow-rate changes or tripping the bit out of the borehole.

According to one aspect, the local bit temperatures measured by temperature sensors 151 at a plurality of locations adjacent teeth of the bit are utilized to detect bit damage and the site thereof. More particularly, the temperatures at the plurality of measurement locations adjacent the teeth are compared to the average bit temperature <T> or to a reference temperature $T_{ref}$. Over time, typical excursions from the average can be noted. A sudden temperature decrease or increase at one particular point relative to the average bit temperature or reference temperature could indicate where a tooth had been lost or damaged. By way of example only, if a tooth is lost but there are other cutters nearby functioning properly, the temperature might drop, whereas if the lost tooth is on an exposed promontory, the temperature might increase due to inefficient rubbing. Likewise, a sudden temperature increase at a particular point could indicate diminished hydraulic cleaning of cutting due to a plugged bit jet adjacent the tooth or teeth monitored by that sensor. Thus, in one embodiment, the temperature at a plurality of teeth are measured and compared to either an average bit temperature or to a reference temperature, and if a sudden temperature decrease or increase for one of the sensors is noted, action is taken accordingly. The action could include, inter alia one or more of increasing, pulsing or cycling the flow pressure of the drilling mud in an attempt to unplug the bit jet, or tripping the bit out of the borehole.

According to one aspect, geological information can be obtained by monitoring the average bit temperature obtained by one or more sensors 151 in conjunction with the rate of penetration (ROP) of the drill bit. More particularly, it is appreciated that wear and bit damage can cause a monotonically increasing temperature of the drill bit with time, and the geothermal gradient causes a very slowly increasing temperature with depth. On the other hand, average temperature of the drill bit may also increase due to increasing formation hardness and/or density, or may decrease due to decreasing formation hardness and/or density. Such variable and potentially reversible temperature changes, if correlated with ROP at a constant WOB and with torque at constant rpm can be interpreted to provide geological information. The geological information can be used for well placement and for correlation purposes. More particularly, if the average temperature of the drill bit rises while the ROP decreases and the torque increases, it can be assumed that the formation hardness has increased. Similarly, if the average temperature of the drill bit decreases while the ROP increases and the torque decreases, it can be assumed that the formation hardness has decreased. Thus, in one embodiment, the average temperature taken from a plurality of teeth is measured and correlated with one or both of the ROP of and torque on the bit. Based on the measurements and correlations determinations are made as to the relative formation hardness at different depths of the formation, and a log of the same can be made.

If the average bit temperature drops without a change in the ROP, this may indicate a gas influx at the bit, or in general, an overpressured zone. Thus, in one embodiment, the average bit temperature obtained through the use of one or more temperature sensors 151 is correlated with the ROP, and if the ratio of average bit temperature to ROP drops, appropriate action is taken. For example, the drilling forward progress may be halted abruptly, the mud weight may be increased appropriately or surface pressure-containing facilities (blow-out preventers) may be actuated and closed.

It should be appreciated that the temperature sensed at any location by the temperature sensor elements may be displayed (via the processor) as a log or in another manner either on paper, on a computer screen, or otherwise. In addition, average bit temperature <T>, rate of change of the average bit temperature, and any desired correlations calculated by the processor may likewise be displayed as a log or in another manner either on paper, on a computer screen, or otherwise. In addition, drill-string rotational velocity (rpm), mud flow-rate, weight-on-bit (WOB) may likewise be displayed. Thus, the processor is programmed or hard-wired or otherwise arranged to provide an output that may be displayed accordingly. Further, the processor in conjunction with associated circuitry or equipment may generate an alarm (audible or visual) when desirable.

Figure 6:
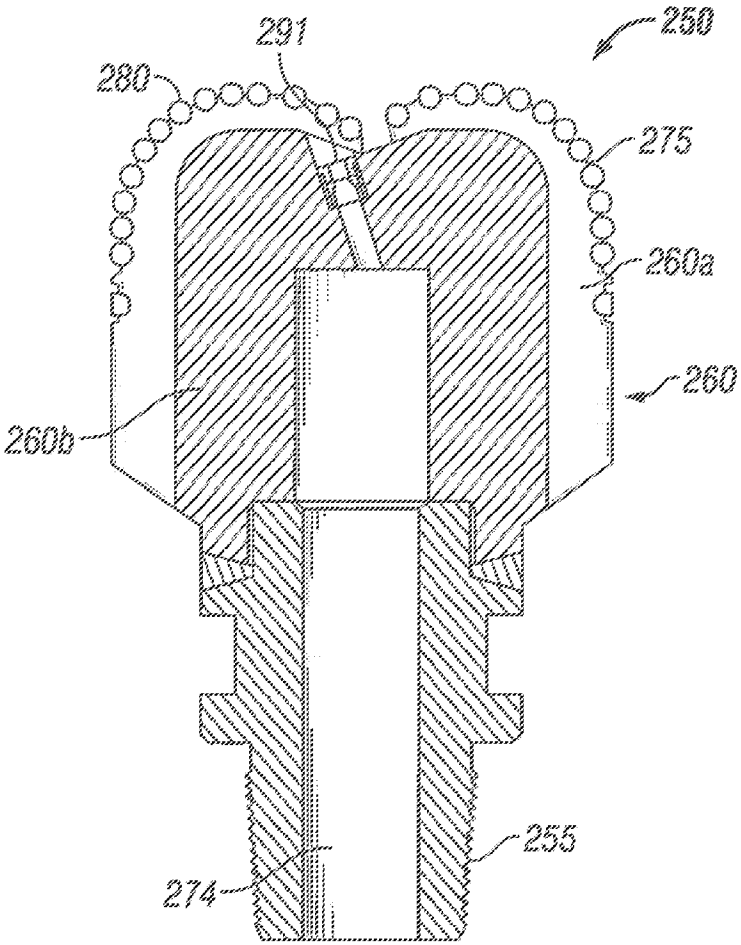
FIG. 6 is a schematic cross-sectional view of the drill bit of FIG. 5.
Figure 5:
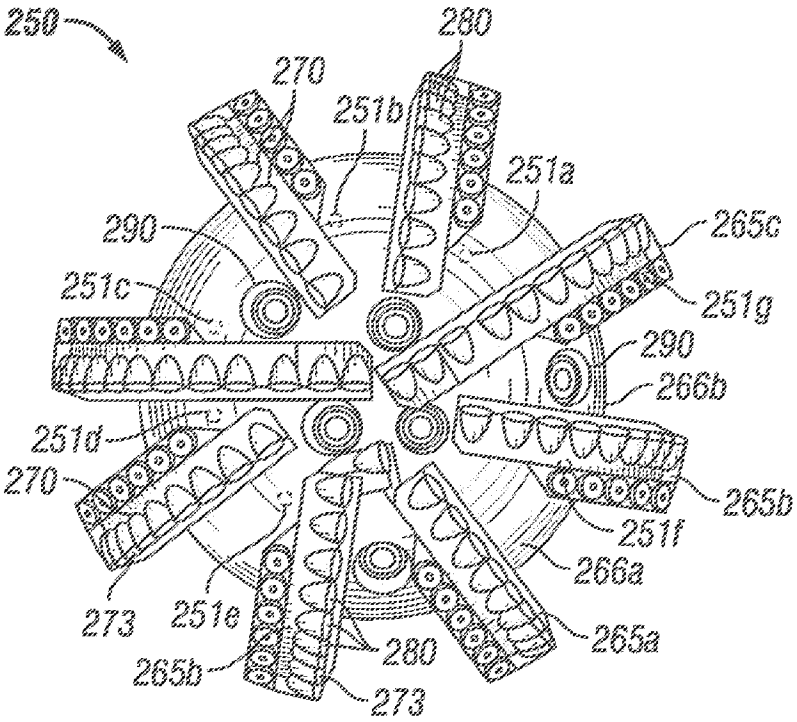
FIG. 5 is a bottom view of a matrix PDC drill bit having a temperature sensor element.

FIGS. 5 and 6 show a stationary drill bit 250 similar to drill bit 150 (with like elements given like numbers but increased by "100"). Stationary drill bit 250 is a "matrix bit" and may be used in conjunction with the drilling rig 10 of FIG. 1. Drill bit 250 includes a shank 255 and a head 260. Head 260 is formed by attaching a tungsten carbide matrix 260*a* to a steel blank 260*b*. The tungsten carbide matrix 260*a* includes a plurality of blades 265*a*, 265*b* . . . , 265*h* (eight shown). Space between the blades 265*a*, 265*b* . . . may be considered flutes 266*a*, 266*b* . . . , and tungsten carbide material may or may not be found there. The blades 265*a*-*h* are generally arcuate (as seen best in FIG. 6) and have a plurality of openings or cavities 270 drilled or formed into their leading faces 273 at the distal ends 275 of the blades. The blades 265*a*-265*h* may have different or the same numbers of openings 270 provided. The openings 270 are generally situated perpendicular to the longitudinal axis of the drill bit and in the direction of rotation of the bit. The openings 270 receive cutting elements or teeth 280 (e.g., PDC teeth) that project from the leading faces 273 and are adapted to scrape and cut. Because the blades are arcuate, the teeth 280 assume different axially positions relative to the longitudinal axis of the drill bit 250. In addition, the teeth 280 may assume different radially positions relative to the longitudinal axis. The drill bit 250 has a central passageway 274 for receiving drilling fluid (mud). At the distal end of the passageway, openings 290*b* are formed in or to the flutes, and a central opening is also provided for receiving nozzles 291 that deliver drilling mud to the drill bit tip 275.

Temperature sensor elements 251 are provided adjacent respective teeth 280 of the tool bit 250. In FIG. 5, seven sensors, 251*a*-251*g*, are shown, however, different numbers of sensors may be utilized. In one embodiment, only one temperature sensor element 251 is provided adjacent a tooth of one of the blades. In other embodiments, at least one temperature sensor element 251 is provided adjacent one tooth of at least two, three, four or all blades. In another embodiment, at least two temperature sensor elements 251 are provided adjacent two different teeth of one of the blades. In another embodiment, at least two temperature sensors elements 251 are provided at different radial positions on two different blades. In one embodiment, temperature sensor element 251*g* is located on a proximal portion of a blade distant the closely spaced teeth 280 or on the shaft 255. The temperature sensors elements 251 can be of any desirable type as previously discussed with reference to FIGS. 3 and 4, and may be located on the blades 265 in the manner previously discussed with reference to FIGS. 3 and 4 or in another desirable manner. In addition, any desired mechanism and method for coupling a temperature sensing element 251 to circuitry or a processor (not shown) may be used consistent with the drilling environment.

With the use of one or more of temperature sensing elements 251*a*-251*g* adjacent the teeth 280 of the drill bit, with or without temperature sensing element 251*g* located on the shank, information can be obtained regarding at least one of the drill bit, the drilling environment, and the formation. More particularly, in one aspect, changes in various local drill bit temperatures may be used to infer changes in the condition or environment of the drill bit. For example, as previously discussed, average bit temperature <T> rise over time d<T>/dt, to the extent that this temperature increase is not attributable to WOB or rpm or mud flow-rate changes or geothermal gradient, could indicate bit wear, bit damage (e.g., lost tooth), or bit balling (accumulation of clay or other materials coating the bit face and preventing the cutters from gaining purchase into the formation). According to another aspect, as discussed above with reference to FIGS. 3 and 4, the local bit temperatures measured by temperature sensors 251 at a plurality of locations adjacent teeth of the bit can be utilized to detect bit damage and the site thereof. According to a further aspect, as discussed above with reference to FIGS. 3 and 4, geological information can be obtained by monitoring the average bit temperature obtained by one or more sensors 251 in conjunction with the rate of penetration (ROP) of the drill bit 250.

Figure 7:
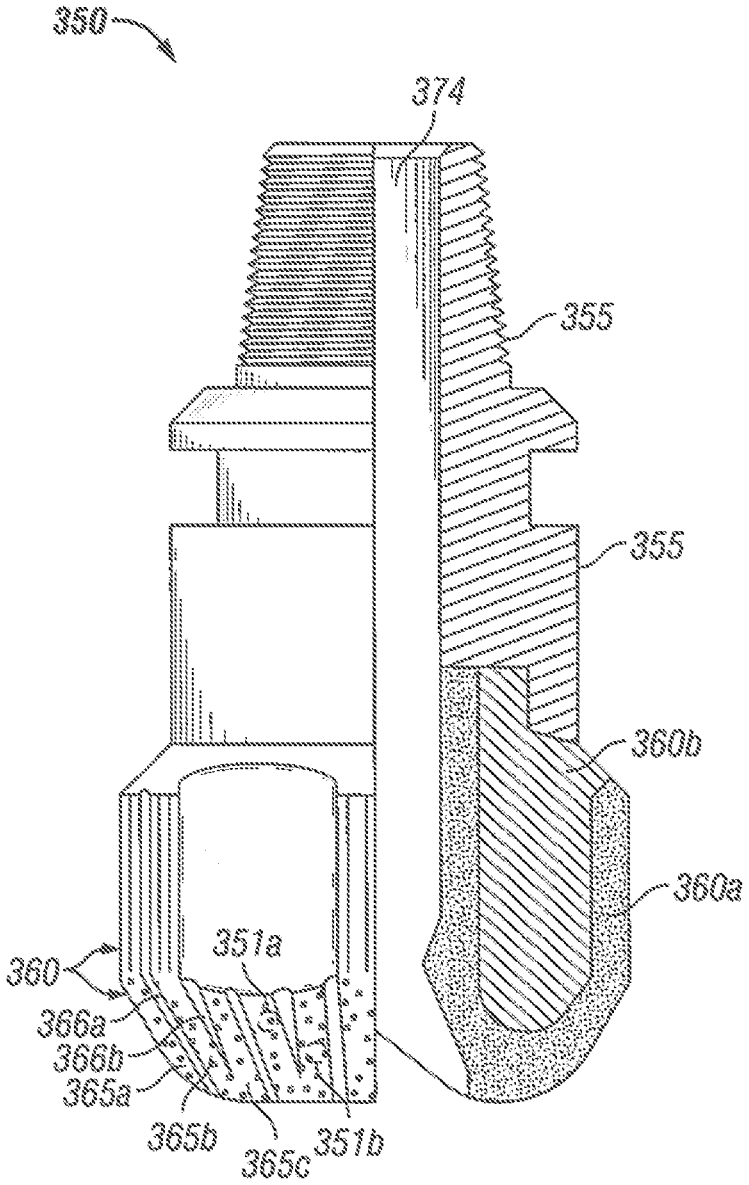
FIG. 7 is a schematic partially cross-sectional view of a diamond drill bit having a temperature sensor element.

FIG. 7 shows a stationary drill bit 350 similar in many respects to drill bit 250 (with like elements given like numbers but increased by "100"). Drill bit 350 is a "natural diamond style bit" and may be used in conjunction with the drilling rig 10 of FIG. 1. Drill bit 350 includes a shank 355 and a head 360. Head 360 is formed by attaching a tungsten carbide matrix 360*a* to a steel blank 360*b*. The surface of the tungsten carbide matrix 360*a* comprises a plurality of diamond pads 365*a*, 365*b* . . . with natural diamond chips. The pads 365 with the diamonds may be considered a combination "blade" with "teeth." Space between the pads may be considered flutes 366*a*, 366*b*. The blades 365 are generally arcuate and may be arranged to form a crown or cone. The drill bit 350 has a central passageway 374 for receiving drilling fluid (mud). At the distal end of the passageway, openings (not shown) are formed for receiving nozzles (not shown) that deliver drilling mud to the drill bit tip.

Temperature sensor elements 351 are provided adjacent the diamond pads of the tool bit 350. In FIG. 7, two sensors, 351*a* and 351*b*, are shown, however, different numbers of sensors may be utilized. In one embodiment, only one temperature sensor element 351 is provided adjacent a pad. In other embodiments, at least one temperature sensor element 351 is provided adjacent two, three, four or all pads. In another embodiment, at least two temperature sensors elements 351 are provided at different radial positions on at least one pad. In one embodiment, a temperature sensor element is located on a proximal portion of the drill bit distant the pads. The temperature sensors elements 351 can be of any desirable type as previously discussed with reference to sensor elements 151 of FIGS. 3 and 4, and may be located adjacent the pads 365 in the manner previously discussed of placement of sensor elements 151 adjacent teeth with reference to FIGS. 3 and 4, or in another desirable manner. In addition, any desired mechanism and method for coupling a temperature sensing element 351 to circuitry or a processor (not shown) may be used consistent with the drilling environment.

With the use of one or more of temperature sensing elements 351*a* adjacent the pads 365 of the drill bit, with or without a temperature sensing element located on the shank, information can be obtained regarding at least one of the drill bit, the drilling environment, and the formation. More particularly, in one aspect, changes in various local drill bit temperatures may be used to infer changes in the condition or environment of the drill bit. For example, as previously discussed, average bit temperature <T> rise over time d<T>/dt, to the extent that this temperature increase is not attributable to WOB or rpm or mud flow-rate changes or geothermal gradient, could indicate bit wear, bit damage (e.g., lost pad), or bit balling (accumulation of clay or other materials coating the bit face and preventing the cutters from gaining purchase into the formation). According to another aspect, as discussed above with reference to FIGS. 3 and 4, the local bit temperatures measured by temperature sensors 351 at a plurality of locations adjacent pads of the bit can be utilized to detect bit damage and the site thereof. According to a further aspect, as discussed above with reference to FIGS. 3 and 4, geological information can be obtained by monitoring the average bit temperature obtained by one or more sensors 351 in conjunction with the rate of penetration (ROP) of the drill bit 350.

Figure 8:
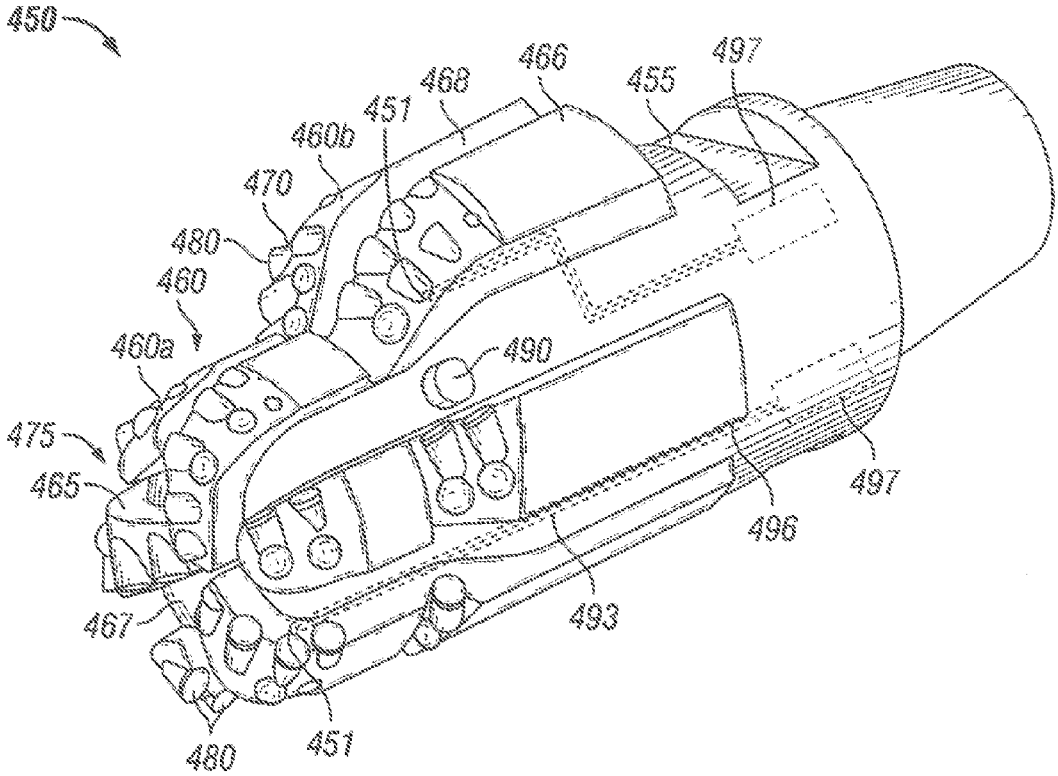
FIG. 8 is a schematic view of a bi-centered PDC drill bit having a plurality of temperature sensor elements.

Turning now to FIG. 8, a schematic view of a bi-centered PDC drill bit 450 is shown having a plurality of temperature sensor elements 451*a*, 451*b* . . . (generally referred to as 451). Drill bit 450 is similar to drill bit 150 of FIGS. 3 and 4 except that it is bi-centered. Thus, besides including a shank 455 and a head 460, the head 460 includes a round cutting head 460*a* with a plurality of distal blades 465 that define therebetween a plurality of flutes 467, and a more proximal eccentric reaming side lobe 460*b* that includes a plurality of proximal blades 466 that define therebetween at least one flute 468. The blades 465, 466 are generally arcuate and have a plurality of openings or cavities 470 drilled or formed into their leading faces at the distal ends of the blades. The blades 465, 466 may have different or the same numbers of openings 470 provided. The openings 470 are generally situated perpendicular to the longitudinal axis of the drill bit and in the direction of rotation of the bit. The openings 470 receive cutting elements or teeth 480 (e.g., PDC teeth) that project from the leading faces and are adapted to scrape and cut. Because the blades are arcuate, the teeth 480 assume different axially positions relative to the longitudinal axis of the drill bit 450. Thus, at least one tooth on the distal blades 465 may be located at an apex (distal-most location) of the drill bit 450. In addition, the teeth 480 may assume different radially positions relative to the longitudinal axis. The drill bit 450 has a central passageway (not shown) for receiving drilling fluid (mud). At the distal end of the passageway, openings 490 are formed in the flutes for receiving nozzles (not shown) that deliver drilling mud to the drill bit tip 475.

In one embodiment, at least one temperature sensor element 451 is located adjacent a tooth 470 on one of the distal blades 465, and at least one temperature sensor element is located adjacent a tooth on one of the proximal blades 466 of the reaming side lobe 460*b*. Data from the temperature sensor elements 451 are passed farther back up the drill string through a physical connector (e.g., electrical or fiber-optical) between the drill bit and the sub above it, or by short-hop wireless means to a receiver located higher up in the drill string. In one embodiment, a bored channel 493 (shown in phantom) carries cabling 496 (shown in phantom) from the temperature sensor(s) back to a dedicated or possibly, shared electronics sub-module 497 (shown in phantom) located back in the protected shank portion 455 of the bit 450.

According to one aspect, local temperature changes measured at various key locations in a bi-centered bit 450 could indicate changing bit motion conditions (bouncing, whirling motion vs. smooth rotation) and/or hole size being drilled. For example, changes in the relative temperatures of a tooth on the outside of the reaming side-lobe and a tooth on the side of the smaller round cutting head may indicate a change in the respective intensities of engagement of these teeth with the formation (cutting duty-cycle). Taking the bi-centered bit's geometry into account, this information may allow the drilling engineer to infer the effective size of the hole being drilled at that moment. Likewise, an increased temperature at a tooth that suggests increased intensity of engagement at a certain point on the bit may correspond to an undesirable bouncing or whirling motion that periodically strikes that point on the bit preferentially against the formation. If the bi-centered drilling bit's motion condition detected is unsatisfactory to the driller in terms of safety, drilling efficiency or wear and tear on the bit, the driller may attempt to modify the bit motion by varying the WOB and/or the rpm conditions while monitoring any changes in the temperature measurement points.

Figure 9:
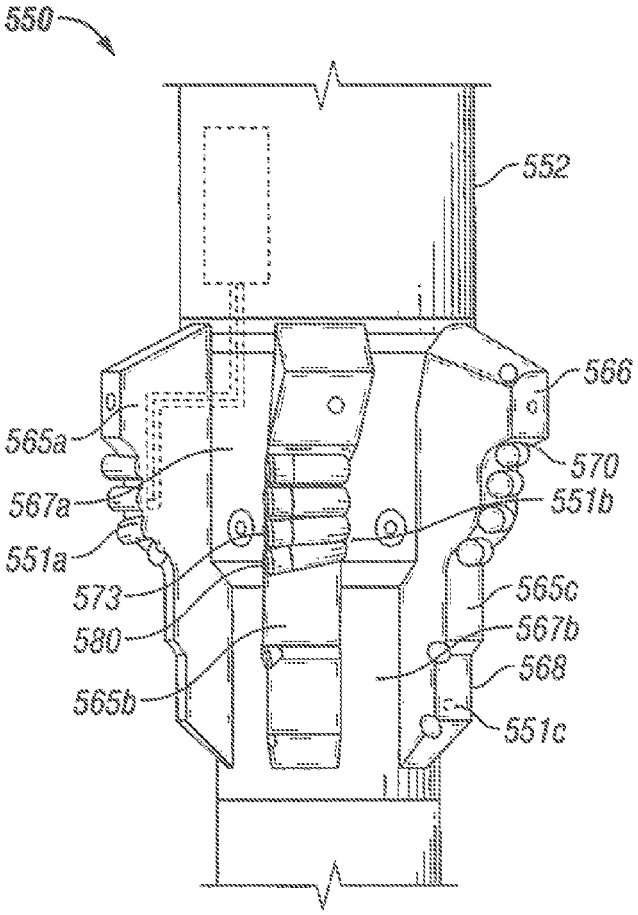
FIG. 9 is a schematic view of a reamer cutter having a temperature sensor element.

A schematic diagram of a reamer 550 located on the drill string proximal of a drilling bit is seen in FIG. 9. Reamers, located higher up the string than drill bits, are widely used in certain drilling conditions to increase the diameter of the borehole beyond the diameter originally drilled by the drill bit at the bottom of the string. Reamers may either be in a fixed-diameter configuration or be capable of expanding their gauge on-demand while downhole.

According to one aspect, a reamer 550 is provided with one or more local temperature sensor elements 551. More particularly, reamer 550 includes a central hollow body 552 with an outer circumference to which a plurality of elongate blades 565*a*, 565*b*, 565*c* . . . (generally referred to as 565) are circumferentially spaced, thereby defining therebetween a plurality of flutes 567*a*, 567*b* . . . . The reamer 550 may include two, three, four or more blades 565. The blades 565 have a proximal portion 566 that extends radially outwardly and is provided with a plurality of openings or cavities 570 formed or drilled into their leading faces 573, and a distal portion 568 which tapers back toward the central hollow body 552. The blades may have different or the same numbers of openings 570 provided. The openings 570 are generally situated perpendicular to the longitudinal axis of the reamer 550 and in the direction of rotation of the drill string. The openings 570 receive cutting elements or teeth 580 (e.g., PDC teeth) that project from the leading faces 573 and are adapted to scrape and cut. The teeth 580 assume different axially positions relative to the longitudinal axis of the reamer 550. The teeth may also be at different radial distances from the longitudinal axis. The hollow body 552 has a central passageway (not shown) for receiving drilling fluid (mud). One or more openings (not shown) may be formed in the flutes to deliver drilling mud to the blades 565 of the reamer.

In FIG. 9, reamer 550 is shown with three temperature sensor elements 551*a*, 551*b*, and 551*c* (each also referred to generally as a temperature sensor 551), although fewer or more may be provided. Temperature sensor elements 551*a* and 551*b* are shown to be adjacent different teeth 580 of the reamer 550, while temperature sensor element 551*c* is shown to be distant the teeth and thus likely to provide a reference temperature.

In one embodiment, only one temperature sensor element 551 is provided adjacent a tooth of one of the blades. In other embodiments, at least one temperature sensor element 551 is provided adjacent one tooth of at least two, three, four or all of the blades. In another embodiment, at least two temperature sensor elements 551 are provided adjacent two different teeth of one of the blades. In another embodiment, at least two temperature sensors elements 551 are provided at different radial positions on two different blades. In one embodiment, temperature sensor element 551 is located on a portion of a blade distant the closely spaced teeth 570 or on a portion of the reamer relatively distant from the teeth 570. The temperature sensors elements 551 can be of any desirable type as previously discussed with reference to FIGS. 3 and 4, and may be located on the blades 565 in the manner previously discussed with reference to FIGS. 3 and 4 or in another desirable manner. In addition, any desired mechanism and method for coupling a temperature sensing element 551 to circuitry or a processor (not shown) may be used consistent with the drilling environment. As shown in FIG. 9, the sensors 551 are coupled to front-end electronic circuitry 596 (shown in phantom) seated in a cavity in a shank 555 of the reamer 550 via multi-conductor electric wiring/cabling 197 (shown in phantom).

In one aspect, the temperature sensor elements 551 are used to monitor the health and effectiveness of the reamer 550. Increasing temperatures could indicate reamer cutter wear or damage, or overly aggressive reaming, possibly with excessive vibration or chattering motion in the hole. As with the drill bit examples above, differentiating between localized, blade-specific or tooth-specific temperature measurements and averaged temperatures can lead to insightful interpretations of the damage conditions, possibly at specific location(s) on the reamer 550.

According to one aspect, one or more temperature sensors may be provided in a mud turbine or positive-displacement motor (PDM) of a drilling bottom-hole assembly. The temperature sensors in the mud turbine or PDM may be in addition to providing temperature sensors adjacent teeth or pads of a drill or teeth of a reamer of a drill string.

Figure 10:
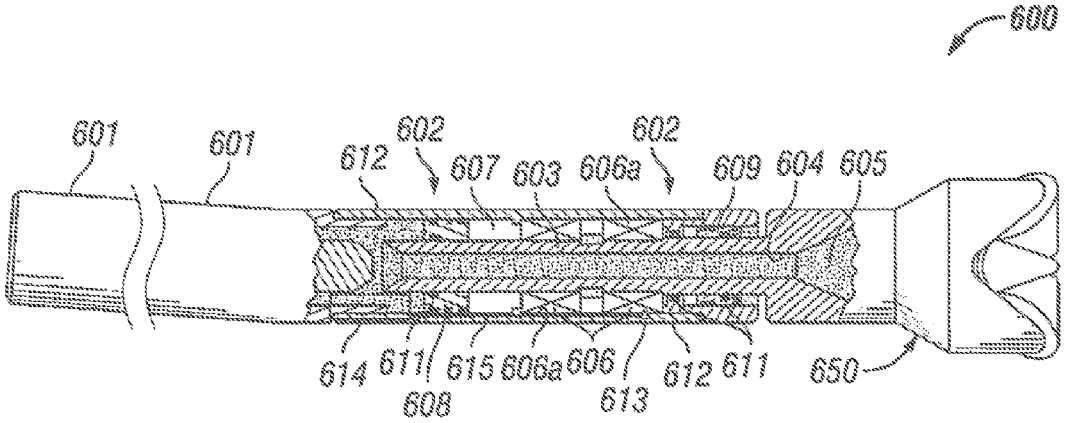
FIG. 10 is a schematic partially cross-sectional view of a drilling motor having temperature sensor adjacent shaft bearings.

A common failure of a drilling motor occurs when rotating shaft bearings (which are either mud-lubricated or sealed and oil-lubricated) become contaminated and/or worn. FIG. 10 is a schematic partially cross-sectional view of a drilling motor 600 with a power section 601, and a sealed bearing assembly 602 which is located proximal a drill bit 650. The sealed bearing assembly 602 is shown with a central shaft 603 that is coupled to the drill bit 650, the central shaft 603 having a pathway 604 for drilling mud 605 to run there-through. Around the shaft 603 are thrust/radial shaft bearings 606 in a bearing housing 606*a*, a lubricant reservoir 607, a pressure compensating piston 608, a barrier piston 609, and a plurality of seals 611 all housed in housing 612. A temperature sensor element 613 is located adjacent one of the shaft bearings 606 (e.g., located in or on the wall of the housing 606*a*). Proximal the pressure compensating piston 608, in one embodiment, a front-end electronic circuitry module 614 is provided. A cable or wire 615 is provided to couple the temperature sensor element 613 and the front-end module 614. In one embodiment, the cable or wire 615 extends through the housing 612.

The temperature sensor 613 of FIG. 10 can be of any desirable type as previously discussed with reference to FIGS. 3 and 4. In addition, any desired mechanism and method for coupling a temperature sensing element 613 to circuitry or a processor (not shown) may be used consistent with the drilling environment.

In one aspect, the temperature sensing element(s) 613 can be used to provide an indication of wear of the mud motor bearings and help to predict end-of-life of the mud motor. Having to trip out to change a failed mud motor (or a failed drill bit) is an extremely costly event, and it is also very beneficial to obtain maximum operating hours of reliable use from both motors and bits when in the well and drilling on an expensive job, particularly in the offshore drilling market.

As discussed above, all of the drilling equipment of FIGS. 2-10 can be used in conjunction with a drilling operation such as shown in FIG. 1. Some of the equipment can be used at the same time (e.g., a drill bit with temperature sensors, a reamer with temperature sensors and a motor with temperature sensors). The processors provided for analyzing the temperature information obtained by the temperature sensors downhole may be located downhole and/or uphole. Any log or other display or audible warning signal is generated uphole. With the provided embodiments, a better monitoring of the generally shorter-lived drilling bottomhole assembly (BHA) components may be accomplished. As a result, it may be possible to optimize the operating conditions of the components as well as to avoid or respond more quickly to dangerous drilling situations. Furthermore, with better monitoring, according to one aspect, it is possible to synchronize the replacement of the BHA components to geologically optimal or necessary tripping-out intervals of the drill string, thereby dramatically improving well construction speed and efficiency and significantly reducing drilling costs.

There have been described and illustrated herein several embodiments of formation drilling systems incorporating temperature sensing elements. While particular embodiments and aspects have been described, it is not intended that the disclosure be limited thereto, and it is intended that the claims be as broad in scope as the art will allow and that the specification be read likewise. Thus, while particular types of stationary drill bits have been described, other types of may be utilized with the temperature sensor elements adjacent the teeth, pads or scraping elements of the bits. Likewise, while particular data transmission mechanisms have been described for transmitting data from the temperature sensor elements to a processor, it will be appreciated that other transmission mechanisms can be utilized. Further, while average temperature determinations have been described as being based on averaging the readings from all of the temperature sensors located adjacent teeth (or pads) of a bit, or from a sensor located distant the teeth, it will be appreciated that fewer than all of the sensors could be utilized to generate an "average." It will therefore be appreciated by those skilled in the art that yet other modifications could be made. Accordingly, all such modifications are intended to be included within the scope of this disclosure as defined in the following claims. In the claims, means-plus-function clauses, if any, are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A formation drill bit system, comprising:

a) a shank defining a longitudinal axis and having a proximal end and a distal end, said shank adapted to being rotated about said longitudinal axis;

b) a drill head fixed to a distal end of said shank, said head having a plurality of stationary blades separated by a plurality of flutes, each of said plurality of blades having a distal end and a leading face in a direction of rotation about said longitudinal axis, each said blade having a plurality of cutting elements arranged on the leading face of the blade at the distal end of the blade; and c) at least one temperature sensing element, said at least one temperature sensing element including a first temperature sensor situated at a location adjacent to a first cutting element of a first of said plurality of blades and arranged for sensing a local temperature of said first blade at said location.

2. A formation drill bit system according to claim 1, wherein:

said at least one temperature sensing element includes a second temperature sensor situated adjacent a second cutting element of said first blade and radially spaced therefrom and arranged for sensing a local temperature of said first blade adjacent said second cutting element.

3. A formation drill bit system according to claim 1, wherein:

said at least one temperature sensing element includes a second temperature sensor situated at a second location adjacent a cutting element of a second blade arranged for sensing a local temperature of said second blade at said second location.

4. A formation drill bit system according to claim 3, wherein:

said plurality of blades includes at least four blades, and said at least one temperature sensing element includes a temperature sensor on each of at said at least four blades situated at a location adjacent a respective cutting element of that blade and arranged for sensing a respective local temperature of its respective location.

5. A formation drill bit system according to claim 4, wherein:

said at least one temperature sensing element includes a temperature sensor located on said shank and arranged for providing a reference temperature for said drilling bit.

6. A formation drill bit system according to claim 4, further comprising:

d) a processor coupled to said each of said temperature sensors on said at least four blades.

7. A formation drill bit system according to claim 6, wherein:

said processor is adapted to provide information regarding at least one of said drill head, an environment in which said drill head is drilling, and a formation in which said drill head is drilling.

8. A formation drill bit system according to claim 7, wherein:

said information comprises rise over time of average bit temperature calculated from an average of local temperatures provided by said at least one temperature sensing element.

9. A formation drill bit system according to claim 7, wherein:

said information comprises rate of temperature rise of average drill bit temperature calculated from an average of local temperatures provided by said at least one temperature sensing element.

10. A formation drill bit system according to claim 6, wherein:

said drill head defines a plurality of passageways terminating at respective temperature sensors, and said formation drill bit system further comprises wires or cables connected to said respective temperature sensors and extending through said passageways.

11. A formation drill bit system according to claim 10, further comprising:

an electronics module located in said shank and connected to said wires or cables, said electronics module communicating with said processor.

12. A formation drill bit system according to claim 1, wherein:

said drill head comprises a bi-centered drill head where said plurality of blades includes a first plurality of distal blades and a second plurality of proximal blades, and said at least one temperature sensing element includes a first temperature sensor adjacent a cutting element of one of said first plurality of distal blades and a second temperature sensor adjacent a cutting element of one of said second plurality of proximal blades.

13. A formation drill bit system according to claim 1, wherein:

said plurality of cutting elements comprise polycrystalline diamond compact teeth.

14. A formation drill bit system according to claim 1, further comprising:

drilling motor located proximal to and coupled to said shank, said drilling motor comprising a sealed bearing assembly with a housing, bearings located in a bearing housing, a lubricant reservoir, and a motor temperature sensor element in contact with said bearing housing and arranged to indicate a temperature of said bearings.

15. A formation drill bit system, comprising:

a) a shank defining a longitudinal axis and having a proximal end and a distal end, said shank adapted to being rotated about said longitudinal axis; and b) a drill head fixed to a distal end of said shank, said head having a plurality of stationary blades separated by a plurality of flutes, each of said plurality of blades comprising a pad having a tungsten carbide matrix with a plurality of natural diamond cutting elements on a surface thereof; and c) at least one temperature sensing element, said at least one temperature sensing element including a first temperature sensor situated at a location adjacent to a pad of a first of said plurality of blades and arranged for sensing a local temperature of said first blade at said location.

16. A formation drill bit system according to claim 15, wherein:

said plurality of blades includes at least four blades, and said at least one temperature sensing element includes a temperature sensor on each of at said at least four blades situated at a location adjacent a respective pad of that blade and arranged for sensing a respective local temperature of its respective location.

17. A formation drill bit system according to claim 16, wherein:

said at least one temperature sensing element includes a temperature sensor located on said shank and arranged for providing a reference temperature for said drilling bit.

18. A formation drill bit system according to claim 16, further comprising:

d) a processor coupled to said each of said temperature sensors on said at least four blades.

19. A formation drill bit system according to claim 18, wherein:

said processor is adapted to provide information regarding at least one of said drill head, an environment in which said drill head is drilling, and a formation in which said drill head is drilling.

20. A formation drill bit system according to claim 19, wherein:

said information comprises rise over time of average bit temperature calculated from an average of local temperatures provided by said at least one temperature sensing element.

21. A formation drill bit system according to claim 19, wherein:

said information comprises rate of temperature rise of average drill bit temperature calculated from an average of local temperatures provided by said at least one temperature sensing element.

22. A formation drill bit system according to claim 18, wherein:

said drill head defines a plurality of passageways terminating at respective temperature sensors, and said formation drill bit system further comprises wires or cables coupled to said respective temperature sensors and extending through said passageways.

23. A formation drilling system, comprising:

a) a drill string having a proximal end and a distal end;

b) a drill bit attached to said distal end of said drill string; and c) a reamer located proximal said distal end of said drill string, said reamer comprising i) a hollow body having a wall and adapted to being rotated about a longitudinal axis;

ii) a plurality of blades circumferentially spaced about an outer circumference of said hollow body wall and defining a plurality of flutes, each of said plurality of blades having a leading face in a direction of rotation about said longitudinal axis, each said blade having a plurality of cutting elements arranged on a leading face of the blade; and iii) at least one temperature sensing element, said at least one temperature sensing element including a first temperature sensor situated at a location adjacent to a first cutting element of a first of said plurality of blades and arranged for sensing a local temperature of said first blade at said location.

24. A formation drilling system according to claim 23, wherein:

said at least one temperature sensing element includes a second temperature sensor situated at a second location adjacent a cutting element of a second blade arranged for sensing a local temperature of said second blade at said second location.

25. A formation drilling system according to claim 23, wherein:

said plurality of blades includes at least four blades, and said at least one temperature sensing element includes a temperature sensor on each of at said at least four blades situated at a location adjacent a respective cutting element of that blade and arranged for sensing a respective local temperature of its respective location.

26. A formation drilling system according to claim 25, wherein:

said at least one temperature sensing element includes a temperature sensor located distant said cutting elements and arranged for providing a reference temperature for said reamer.

27. A formation drilling system according to claim 24, further comprising:

d) a processor coupled to said each of said temperature sensors on said at least four blades.

28. A formation drilling system according to claim 27, wherein:

said processor is adapted to provide information regarding said reamer.

29. A formation drilling system according to claim 28, wherein:

said first blade and said second blade each defines a passageway extending there-through and terminating at a respective said temperature sensor, and said formation drilling system further comprises wires or cables connected to said respective temperature sensors and extending through said passageways.

30. A formation drill bit system according to claim 29, further comprising:

an electronics module located in said reamer and connected to said wires or cables, said electronics module communicating with said processor.

31. A method of drilling a borehole in a geological formation, comprising:

a) drilling the formation with a drill bit including (i) a shank defining a longitudinal axis and having a proximal end and a distal end, said shank adapted to being rotated about said longitudinal axis, (ii) a drill head fixed to a distal end of said shank, said head having a plurality of blades separated by a plurality of flutes, each of said plurality of blades having a distal end and either a plurality of cutting elements arranged on a leading edge of the distal end of the blade or on a pad on the blade, and (iii) a plurality of temperature sensing elements, at least a first sensor of said plurality of temperature sensing elements located at a first location adjacent either a cutting element arranged on a leading edge of the distal end of a first blade or adjacent a pad on said first blade and arranged for sensing a local temperature of said first blade at said first location, and at least a second sensor of said plurality of temperature sensing elements located at a second location either distant from said cutting elements and arranged for sensing a reference temperature or adjacent either a cutting element arranged on a leading edge of the distal end of a second blade or adjacent a pad on said second blade and arranged for sensing a local temperature of said second blade at said second location;

b) providing a processor coupled to said plurality of temperature sensor elements;

c) with said first sensor, sensing a local temperature of said first blade at said first location;

d) with said second sensor, sensing either a local temperature of said second blade or a reference temperature at said second location;

e) transmitting to said processor data relating to said local temperature of said first blade at said first location and to said either a local temperature of said second blade or a reference temperature at said second location;

f) processing said data with said processor in order to obtain information regarding at least one of said drill bit system and said geological formation.

32. A method according to claim 31, wherein:

said drilling includes drilling the formation with the drill bit at a controlled rotational velocity, with a known weight-on-bit, and providing drilling mud to said drill bit at a known mud-flow rate, and said method further comprises g) modifying at least one of said rotational velocity, weight-on-bit, and mud-flow rate in response to said information.

33. A method according 31, wherein:

said drilling includes drilling the formation with said drill head at a controlled rotational velocity, with a known weight-on-bit, and providing drilling mud to said drill head at a known mud-flow rate, and said method further comprises h) tripping said drill bit out of the borehole.

34. A method according to claim 31, wherein:

said processing comprises comparing said local temperature of said first blade with either said local temperature of said second blade or said reference temperature.

35. A method according to claim 31, wherein:

said plurality of temperature sensing elements includes said first sensor, said second sensor on said second blade, and at least a third sensor on a third blade and a fourth sensor on a fourth blade, said transmitting includes transmitting data regarding local temperature information of said first blade, said second blade, said third blade, and said fourth blade, said processing includes averaging said local temperature information to obtain an average.

36. A method according to claim 35, wherein:

said processing includes comparing over time local temperature information of said first blade, said second blade, said third blade and said fourth blade to said average.

37. A method according to claim 31, wherein:

said processing includes monitoring over time a rate of change of temperature at said first location.

38. A method according to 31, wherein:

said plurality of temperature sensing elements includes said first sensor, said second sensor at a location distant from said cutting elements, and at least a third sensor on a second blade and a third sensor on a third blade, said transmitting includes transmitting data regarding local temperature information of said first blade, said third blade, and said fourth blade, and reference temperature information from said second sensor, said processing includes comparing said local temperature information from said first blade, said third blade and said fourth blade to said reference temperature information.

39. A method according to claim 31, further comprising:

monitoring rate-of-penetration of said bit into said formation, wherein said processing comprises comparing said rate-of-penetration and said data to obtain information regarding said geological formation.

40. A method according to claim 39, wherein:

said information regarding said geological formation comprises at least one of relative formation hardness, relative formation density, and the presence of an over pressurized zone.

* * * * *